US009950544B2

(12) United States Patent
Evers et al.

(10) Patent No.: US 9,950,544 B2
(45) Date of Patent: Apr. 24, 2018

(54) PREVENTING BLEEDING OF MULTI-COLOR PRINT BY IN-LINE JETTING

(71) Applicant: OCÉ-TECHNOLOGIES B.V., Venlo (NL)

(72) Inventors: Roy W. N. Evers, Venlo (NL); Jozef P. Moonen, Venlo (NL); Peter R. Markies, Venlo (NL); Peter O. Colin, Venlo (NL); Franciscus J. H. M. Van Den Beucken, Venlo (NL); Ke Peng, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/292,685

(22) Filed: Oct. 13, 2016

(65) Prior Publication Data

US 2017/0106668 A1 Apr. 20, 2017

(30) Foreign Application Priority Data

Oct. 14, 2015 (EP) ..... 15189750

(51) Int. Cl.
*B41J 2/01* (2006.01)
*B41J 11/00* (2006.01)

(52) U.S. Cl.
CPC ..... *B41J 11/0015* (2013.01); *B41J 2/01* (2013.01)

(58) Field of Classification Search
None
See application file for complete search history.

(56) References Cited

U.S. PATENT DOCUMENTS 4,759,982 A * 7/1988 Jenssen ..... B44C 1/1733 29/527.4
7,645,036 B2 1/2010 Umebayashi et al.
8,083,339 B2 12/2011 Furukawa et al.
2008/0257211 A1* 10/2008 Oriakhi ..... C09D 11/322 106/31.65
2009/0085996 A1 4/2009 Kasai
2010/0209611 A1* 8/2010 Ohshima ..... B41J 2/1606 427/256
2010/0221460 A1* 9/2010 Wexler ..... B41M 5/5218 428/32.1
2014/0170395 A1* 6/2014 Kasperchik ..... C09D 11/40 428/204
2014/0171558 A1 6/2014 Yatake et al.
2015/0116425 A1 4/2015 De Meutter et al.
2015/0184011 A1* 7/2015 Shimura ..... B41J 2/1631 347/21

FOREIGN PATENT DOCUMENTS

WO WO 2009/116678 A1 9/2009

* cited by examiner

*Primary Examiner* — Erica Lin
(74) *Attorney, Agent, or Firm* — Birch, Stewart, Kolasch & Birch, LLP

(57) ABSTRACT

An ink-jet printing method includes printing an image with at least one ink on a recording medium, and applying a cover liquid on the image formed with the at least one ink within 1 s after printing the image with the at least one ink. An ink-jet printing apparatus includes at least one printing unit for printing an image with at least one ink on a recording medium, and an application unit for applying a cover liquid on the image formed with the at least one ink.

9 Claims, 7 Drawing Sheets

PREVENTING BLEEDING OF MULTI-COLOR PRINT BY IN-LINE JETTING

CROSS-REFERENCE TO RELATED APPLICATIONS

This application claims priority under 35 U.S.C. § 119(a) to Application No. 15189750.1, filed in Europe on Oct. 14, 2015, the entire contents of which is hereby incorporated by reference into the present application.

BACKGROUND OF THE INVENTION

1. Field of the Invention

The present invention relates to an ink-jet printing method, comprising the steps of printing an image with at least one ink on a recording medium; and applying a cover liquid on the image formed with the at least one ink within 1 s after printing the image with the at least one ink. The present invention also relates to an ink-jet printing apparatus, comprising at least one printing unit configured to print an image with at least one ink on a recording medium; and an application unit configured to apply a cover liquid on the image formed with the at least one ink.

2. Description of Background Art

During printing of inks, e.g. latex inks, two colors touch each other, bleeding can occur, i.e. a macroscopic flow of ink from one "color" into another. This effect creates unsharp boundaries between different colors on a print, which is unwanted.

Possibilities to overcome the bleeding problem have been analyzed from different points of view of the printing process.

In this regard, U.S. Pat. No. 8,083,339 discloses a treating liquid that is to be applied before printing of a recording liquid. However, the treatment liquids disclosed contain crashing agents (coagulation agents; destabilization agents; which are compounds reactive with an ink component) for pinning purposes.

U.S. Pat. No. 7,645,036 discloses a treatment liquid and ink combination, wherein the reaction liquid is applied prior to the ink compositions. However, the disclosed inks are curable ink compositions. Furthermore, the reaction liquids also contain curable compounds.

Taken together, U.S. Pat. No. 7,645,036 describes an ink spread suppressing liquid, and U.S. Pat. No. 8,083,339 describes a treating liquid, both liquids being printed before printing of the recording liquid and having both a lower surface tension than the recording liquid in order to reduce image bleeding. However, both methods have the disadvantage that the treating liquid interacts with the recording medium and that the treating liquids contain further substances that are undesirable in the printing process. In addition, the treating liquids disclosed in these two documents spread more than the recording liquids applied on top of the treating liquid.

In addition, U.S. Patent Application Publication No. 2014-171558 A1 describes a method for printing wherein bleeding is resolved by variations on the same two principles: either it is prevented by some mechanism involving increased penetration of the ink into the medium, and thus preventing inter-color bleed, or it is prevented by a destabilization mechanism—i.e. precipitation on the surface with a primer—of a pigment or a polymer in an ink which "locks" the color into place on the medium, thus preventing bleeding. This comes at a cost, though, as increasing the penetration of inks can lead to low optical density or strike-through of the print. Further, the destabilization mechanism precludes the use of stable pigments or the use of dye inks. It demands a reaction liquid and an ink which have been specifically tuned to each other. Often, these systems use salts or other ionic moieties which can be destructive for the printhead, e.g. due to corrosivity.

Therefore there is a need for a simple ink-jet printing method that can efficiently prevent bleeding without requiring a special pre-treatment of the recording medium and special agents used therefore, which can be detrimental to the printing method and/or the printing apparatus.

SUMMARY OF THE INVENTION

In contrast to the state of the art, the inventors adopted a completely different approach using a completely different mechanism purely based on surface tension. They observed that bleeding occurs due to the creation of a surface tension gradient between neighboring color surfaces, and that a low surface tension liquid can remove this gradient on the ink-air surfaces. The inventors also found out that the mixing of two or more different liquids on the recording medium, e.g. two or more different printing inks, due to the Marangoni effect can be sufficiently prevented using a cover liquid/overcoat on top of the ink after printing, wherein the cover liquid has a surface tension that is smaller than the surface tension of the ink, particularly two or more inks. In addition, the inventors further found that by applying the cover liquid on the ink, the ink can be effectively kept in the area printed. Furthermore, the inventors observed that the cover liquid has to be applied in a certain time frame, i.e. within 1 s after printing the image, to effectively prevent bleeding.

Thus, the only demand the anti-bleeding coating, i.e. cover liquid, puts on the ink is that the surface tension of the inks must be higher than the cover liquid. This means that the inks can be optimized for other aspects like drying speed and spreading without taking bleeding into account. This also means that this solution can be used on all inks and on all recording media—provided that the surface tension of the cover liquid is lower than that of the ink. Furthermore, because the cover liquid is applied in a time frame that counteracts the Marangoni flow, e.g. jetted in-line, it can act to counter bleeding before it occurs (timescale).

In contrast to the background art, a treatment liquid is used as a cover liquid and printed on top of a printed image within the bleeding time scale and suppresses bleeding. Thus, there is less restrictions on the cover liquid, and the addition of additives—as in the background art—regarding the suitability of the treating liquid for suitably printing on and/or treating the recording medium—is not necessary. Also, the state of the art did not take into account bleeding time scale of the recording liquid (especially at full coverage printing).

The inventors found that a function of the cover liquid is the elimination of surface tension gradients (ink-air) such that (inter color) bleeding is mitigated.

According to one aspect, the present invention relates to an ink-jet printing method, comprising the steps of: printing an image with at least one ink on a recording medium; and applying a cover liquid on the image formed with the at least one ink within 1 s after printing the image with the at least one ink, wherein the cover liquid has a surface tension that is smaller than the surface tension of the at least one ink.

Using the present printing method, color bleed can be sufficiently prevented by in-line jetting a cover liquid on top of a wet print with a lower surface tension than the inks used for printing. The jetted ink droplets forming the wet print, having a higher surface tension than the cover liquid, tend to bleed into each other due to the creation of a surface tension gradient between neighboring ink droplet surfaces before the wet print is dried, which fixes the ink droplets. When the cover liquid, having a lower surface tension than the inks used, is applied on top of the wet print before drying the wet print, the cover liquid suppresses the bleeding tendencies of the ink droplets. Thus, by jetting the cover liquid on top of a wet print the color bleeding can be countered before the wet print is dried by, for example, a drying and fixing unit 20. Hence, the application unit 21 is thereby arranged as close to the last inkjet marking device 111 as possible, particularly that the cover liquid is applied within is after application of the last ink in the inkjet marking device 111, preferably within 1 s after printing the first ink.

According to a further aspect, the present invention relates to an ink-jet printing apparatus, comprising: at least one printing unit configured to print an image with at least one ink on a recording medium; and an application unit configured to apply the cover liquid on the image formed with the at least one ink within 1 s after printing the image with the at least one ink, wherein the cover liquid has a surface tension that is smaller than the surface tension of the at least one ink.

The present ink-jet apparatus can be particularly applied to perform the present ink-jet printing method.

Further aspects and embodiments of the invention are disclosed in the following description, figures and examples, without being limited thereto. Therefore the invention pertains to:

According to the present invention, a first aspect of an ink-jet printing method comprises the steps of: printing an image with at least one ink on a recording medium; and applying a cover liquid on the image formed with the at least one ink within 1 s after printing the image with the at least one ink, wherein the cover liquid has a surface tension that is smaller than the surface tension of the at least one ink, and wherein the cover liquid is applied while the image formed with the at least one ink is still wet.

According to a second aspect of the ink-jet printing method, the cover liquid is applied within a time scale of 1 ms to 1 s after printing the image with the at least one ink.

According to a third aspect of the ink-jet printing method, the cover liquid does not react with the at least one ink.

According to a fourth aspect of the ink-jet printing method, the cover liquid is jetted onto the printed image printed with the at least one ink on the recording medium.

According to a fifth aspect of the ink-jet printing method, the image printed is dried after the cover liquid is applied.

According to a sixth aspect of the ink-jet printing method, the at least one ink has a surface tension of between 20 and 45 mN/m.

According to a seventh aspect of the ink-jet printing method, the at least one ink is water-based and the cover liquid comprises at least one latex.

According to the present invention, a first aspect of an ink-jet printing apparatus comprises: at least one printing unit configured to print an image with at least one ink on a recording medium; and an application unit configured to apply the cover liquid on the image formed with the at least one ink within 1 s after printing the image with the at least one ink, wherein the cover liquid has a surface tension that is smaller than the surface tension of the at least one ink.

According to a second aspect of the ink-jet printing apparatus, the application unit is configured to apply the cover liquid within a time scale of 1 ms to 1 s after printing the image with the at least one ink.

According to a third aspect of the ink-jet printing apparatus, the application unit is configured to jet the cover liquid onto the printed image printed with the at least one ink on the recording medium.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 2A-2C are schematic representations of an inkjet marking device, wherein FIGS. 2A and 2B illustrate inkjet head assemblies and FIG. 2C is a detailed view of a part of the inkjet head assemblies of FIGS. 2A and 2B;

DETAILED DESCRIPTION OF THE PREFERRED EMBODIMENTS

Figure 1:
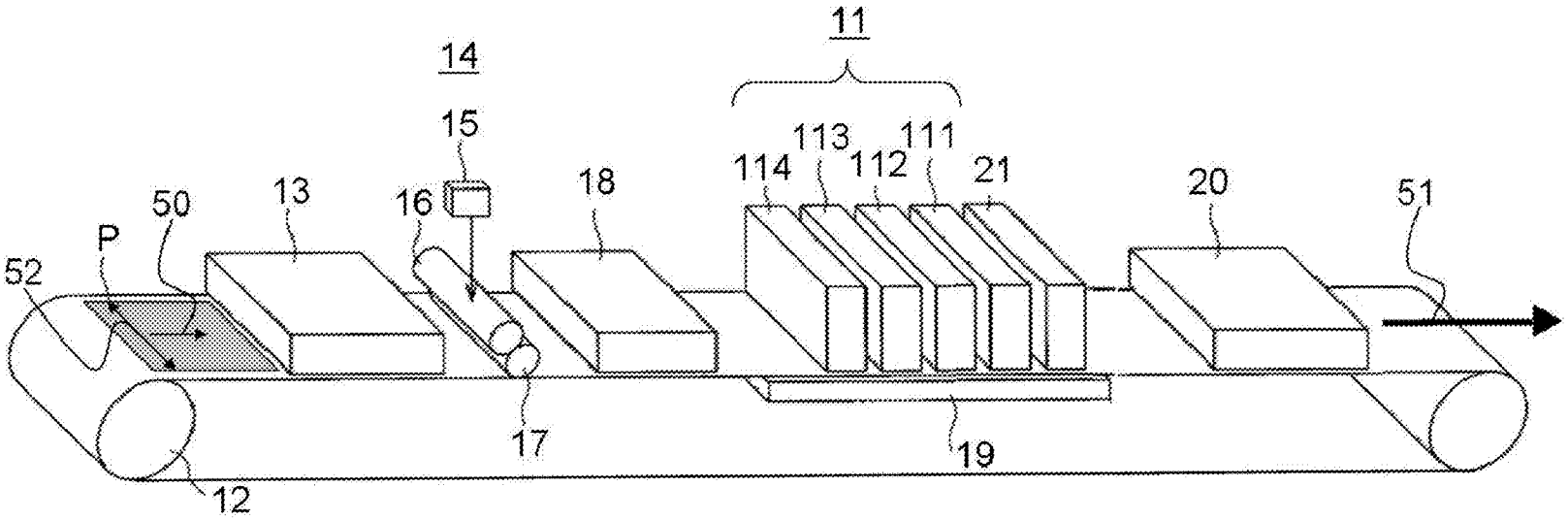
FIG. 1 is a schematic representation of an inkjet printing system.

The present invention will now be described with reference to the accompanying drawings, wherein the same reference numerals have been used to identify the same or similar elements throughout the several views.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims is herewith disclosed.

Further, the terms and phrases used herein are not intended to be limiting; but rather, to provide an understandable description of the invention. The terms “a” or “an”, as used herein, are defined as one or more than one. The term plurality, as used herein, is defined as two or more than two. The term another, as used herein, is defined as at least a second or more. The terms including and/or having, as used herein, are defined as comprising (i.e., open language).

In the present specification, amounts of a substance are usually given as mass percent (m %, wt %), unless noted otherwise or clear from the context.

According to one aspect, the present invention relates to an ink-jet printing method, comprising: printing an image with at least one ink on a recording medium; and applying a cover liquid on the image formed with the at least one ink within 1 s after printing the image with the at least one ink, wherein the cover liquid has a surface tension that is smaller than the surface tension of the at least one ink.

According to certain aspects of the present invention, an image with at least two inks, e.g. two, three, and/or four inks is printed on the recording medium. When two or more inks are applied, they can have the same or different surface tensions.

Recording/Receiving Media

Suitable recording media for use in a printing process using an ink or set of inks (e.g. Cyan, Magenta, Yellow and blacK, CMYK) according to the present invention are not particularly limited to any type. The receiving medium may be suitably selected depending on the intended application.

Suitable receiving media may range from strongly water absorbing media such as plain paper (for example Océ Red Label) to non-water-absorbing media such as plastic sheets (for example PE, PP, PVC and PET films). To optimize print quality, inkjet coated media are known, which media comprise a highly water absorbing coating.

Of particular interest in the context of the present invention are Machine Coated (MC) media (also known as offset coated media) and glossy (coated) media, particularly MC media. MC media are designed for use in conventional printing processes, for example offset printing and show good absorption characteristics with respect to solvents used in inks used in such printing processes, which are usually organic solvents. MC and glossy media show inferior absorption behavior with respect to water (worse than plain paper, better than plastic sheets), and hence aqueous inks.

Machine coated or offset coated media comprise a base layer and a coating layer.

The base layer may be a sheet of paper mainly made of wood fibers or a non-woven fabric material comprising wood fibers combined with synthetic fibers. The base layer may be made of wood pulp or recycled paper pulp and may be bleached.

As an internal filler for the base, a conventional white pigment may be used. For example, the following substances may be used as a white pigment: an inorganic pigment such as precipitated calcium carbonate, heavy calcium carbonate, kaolin, clay, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic silica, aluminum hydroxide, alumina, lithophone, zeolite, magnesium carbonate, or magnesium hydrate; and an organic pigment such as styrene plastic pigment, acrylic plastic pigment, polyethylene, microcapsule, urea resin, or melamine resin. These may be used alone or in combination.

As an internal sizing agent used when producing the base, a neutral rosin size used for neutral papermaking, alkenyl succinic anhydride (ASA), alkyl ketene dimer (AKD), or a petroleum resin size may be used. Especially, a neutral rosin size and alkenyl succinic anhydride are preferable. Alkyl ketene dimer has a high sizing effect and therefore provides an enough sizing effect with a small amount. However, since alkyl ketene dimer reduces the friction coefficient of the surface of recording paper (medium), recording paper made using alkyl ketene dimer may cause a slip when being conveyed in an ink jet recording apparatus.

The thickness of the base is not particularly limited and may be suitably selected in accordance with the intended use. It is, however, preferably 50 μm to 300 μm. The basis weight of the base is preferably 45 $g/m^2$ to 290 $g/m^2$.

The coating layer may comprise a (white) pigment, a binder and may further contain a surfactant and other components as required.

An inorganic pigment or a combination of an inorganic pigment and an organic pigment can be used as the pigment.

Examples of the inorganic pigment include kaolin, talc, calcium bicarbonate, light calcium carbonate, calcium sulfite, amorphous silica, titanium white, magnesium carbonate, titanium dioxide, aluminum hydroxide, calcium hydroxide, magnesium hydroxide, zinc hydroxide and chlorite. Among these, kaolin is particularly preferable due to its superior glossability. The addition amount of the kaolin is preferably 50 parts by mass or more with respect to 100 parts of the binder in the coating layer. When the amount of kaolin is less than 50 parts by mass, adequate effects are unable to be obtained with respect to glossiness.

Examples of the organic pigment include (aqueous) dispersions of, for example, styrene-acrylic copolymer particles, styrene-butadiene copolymer particles, polystyrene particles or polyethylene particles. These organic pigments may be used in combination. The addition amount of the organic pigment is preferably 2 parts by mass to 20 parts by mass with respect to 100 parts by mass of the total amount of the pigment in the coating layer. Since the organic pigment has superior glossability and the specific gravity thereof is small in comparison with inorganic pigment, it allows the obtaining of a coating layer having high bulk, high gloss and satisfactory surface coatability.

An aqueous resin is preferably used for the binder. At least one of a water-soluble resin and a water-dispersible resin is preferably used for the aqueous resin. There are no particular limitations on the water-soluble resin, the water-soluble resin can be suitably selected according to the intended use. Examples thereof include polyvinyl alcohol and polyvinyl alcohol modification products such as anion-modified polyvinyl alcohol, cation-modified polyvinyl alcohol or acetal-modified polyvinyl alcohol; polyurethane; polyvinyl pyrrolidone and polyvinyl pyrrolidone modification products such as copolymers of polyvinyl pyrrolidone and vinyl acetate, copolymers of vinyl pyrrolidone and dimethylaminoethyl methacrylate, copolymers of quaternized vinyl pyrrolidone and dimethylaminoethyl methacrylate or copolymers of vinyl pyrrolidone and methacrylamide propyl trimethyl ammonium chloride; celluloses such as carboxymethyl cellulose, hydroxyethyl cellulose or hydroxypropyl cellulose; cellulose modification products such as cationized hydroxyethyl cellulose; synthetic resins such as polyester, polyacrylic acid (ester), melamine resin or modification products thereof or copolymers of polyester and polyurethane; and poly(meth)acrylic acid, poly(meth)acrylamide, oxidized starch, phosphoric acid-esterified starch, self-modifying starch, cationized starch, various types of modified starch, polyethylene oxide, sodium polyacrylate and sodium arginate. These water-soluble resins may be used alone or in combination.

There are no particular limitations on the water-dispersible resin, a water-dispersible resin can be suitably selected in accordance with the intended use, and examples thereof include polyvinyl acetate, ethylene-vinyl acetate copolymers, polystyrene, styrene-(meth)acrylic acid ester copolymers, (meth)acrylic acid ester copolymers, vinyl acetate-(meth)acrylic acid (ester) copolymers, styrene-butadiene copolymers, ethylene-propylene copolymers, polyvinyl ether and silicone-acrylic copolymers. In addition, a cross-linking agent such as methylolated melamine, methylolated urea, methylolated hydroxypropylene urea or isocyanate may also be contained, and the water-dispersible resin may self-crosslink with a copolymer containing a unit such as N-methylolacrylamide. A plurality of these aqueous resins can also be used simultaneously. The addition amount of the aqueous resin is preferably 2 parts by mass to 100 parts by mass and more preferably 3 parts by mass to 50 parts by mass with respect to 100 parts by mass of the pigment. The amount of the aqueous resin is determined so that the liquid absorption properties of the recording media are within a desired range.

According to certain embodiments, the recording medium has a hydrophobic surface.

Ink

An ink composition used in the ink in the present method is not particularly limited and can, e.g. comprise a water-dispersible resin, a water-dispersible colorant, water, a cosolvent, a surfactant and optionally other additives. Preferably, the ink is water-based. In the ink, the amount of each component is not particularly limited as long as a printing ink is obtained.

Water Dispersible Resin (Latex Resin)

Examples of the water-dispersible resin include synthetic resins and natural polymer compounds. Examples of the synthetic resins include polyester resins, polyurethane resins, polyepoxy resins, polyamide resins, polyether resins, poly(meth)acrylic resins, acryl-silicone resins, fluorine-based resins, polyolefin resins, polystyrene-based resins, polybutadiene-based resins, polyvinyl acetate-based resins, polyvinyl alcohol-based resins, polyvinyl ester-based resins, polyvinyl chloride-based resins, polyacrylic acid-based resins, unsaturated carboxylic acid-based resins and copolymers such as styrene-acrylate copolymer resins, styrene-butadiene copolymer resins. Examples of the natural polymer compounds include celluloses, rosins, and natural rubbers.

Examples of commercially available water-dispersible resin emulsions include: Joncryl 537 and 7640 (styrene-acrylic resin emulsion, made by Johnson Polymer Co., Ltd.), Microgel E-1002 and E-5002 (styrene-acrylic resin emulsion, made by Nippon Paint Co., Ltd.), Voncoat 4001 (acrylic resin emulsion, made by Dainippon Ink and Chemicals Co., Ltd.), Voncoat 5454 (styrene-acrylic resin emulsion, made by Dainippon Ink and Chemicals Co., Ltd.), SAE-1014 (styrene-acrylic resin emulsion, made by Zeon Japan Co., Ltd.), Jurymer ET-410 (acrylic resin emulsion, made by Nihon Junyaku Co., Ltd.), Aron HD-5 and A-104 (acrylic resin emulsion, made by Toa Gosei Co., Ltd.), Saibinol SK-200 (acrylic resin emulsion, made by Saiden Chemical Industry Co., Ltd.), and Zaikthene L (acrylic resin emulsion, made by Sumitomo Seika Chemicals Co., Ltd.), acrylic copolymer emulsions of DSM Neoresins, e.g. the NeoCryl product line, in particular acrylic styrene copolymer emulsions NeoCryl A-662, NeoCryl A-1131, NeoCryl A-2091, NeoCryl A-550, NeoCryl BT-101, NeoCryl SR-270, NeoCryl XK-52, NeoCryl XK-39, NeoCryl A-1044, NeoCryl A-1049, NeoCryl A-1110, NeoCryl A-1120, NeoCryl A-1127, NeoCryl A-2092, NeoCryl A-2099, NeoCryl A-308, NeoCryl A-45, NeoCryl A-615, NeoCryl BT-24, NeoCryl BT-26, NeoCryl BT-26, NeoCryl XK-15, NeoCryl X-151, NeoCryl XK-232, NeoCryl XK-234, NeoCryl XK-237, NeoCryl XK-238-NeoCryl XK-86, NeoCryl XK-90 and NeoCryl XK-95 However, the water-dispersible resin emulsion is not limited to these examples.

The water-dispersible resin may be used in the form of a homopolymer, a copolymer or a composite resin, and all of water-dispersible resins having a monophase structure or core-shell structure and those prepared by power-feed emulsion polymerization may be used.

Water-Dispersible Colorant

A water-dispersible colorant may be a pigment or a mixture of pigments, a dye or a mixture of dyes or a mixture comprising pigments and dyes, as long as the colorant is water-dispersible. The pigment is not particularly limited and may be suitably selected in accordance with the intended use.

Examples of the pigment usable include those commonly known without any limitation, and either a water-dispersible pigment or an oil-dispersible pigment is usable. For example, an organic pigment such as an insoluble pigment or a lake pigment, as well as an inorganic pigment such as carbon black, is preferably usable.

Examples of the insoluble pigments are not particularly limited, but preferred are an azo, azomethine, methine, diphenylmethane, triphenylmethane, quinacridone, anthraquinone, perylene, indigo, quinophthalone, isoindolinone, isoindoline, azine, oxazine, thiazine, dioxazine, thiazole, phthalocyanine, or diketopyrrolopyrrole dye.

For example, inorganic pigments and organic pigments for black and color inks are exemplified. These pigments may be used alone or in combination. As the inorganic pigments, it is possible to use carbon blacks produced by a known method such as a contact method, furnace method and thermal method, in addition to titanium oxide, iron oxide, calcium carbonate, barium sulfate, aluminum hydroxide, barium yellow, cadmium red and chrome yellow.

As the organic pigments, it is possible to use azo pigments (including azo lake, insoluble azo pigments, condensed pigments, chelate azo pigments and the like), polycyclic pigments (e.g., phthalocyanine pigments, perylene pigments, perynone pigments, anthraquinone pigments, quinacridone pigments, dioxazine pigments, indigo pigments, thioindigo pigments, isoindolinone pigments, and quinophthalone pigments), dye chelates (e.g., basic dye type chelates, and acidic dye type chelates), nitro pigments, nitroso pigments, aniline black. Among these, particularly, pigments having high affinity with water are preferably used.

Specific pigments which are preferably usable are listed below.

Examples of pigments for magenta or red include: C.I. Pigment Red 1, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 17, C.I. Pigment Red 22, C.I. Pigment Red 23, C.I. Pigment Red 31, C.I. Pigment Red 38, C.I. Pigment Red 48:1, C.I. Pigment Red 48:2 (Permanent Red 2B(Ca)), C.I. Pigment Red 48:3, C.I. Pigment Red 48:4, C.I. Pigment Red 49:1, C.I. Pigment Red 52:2; C.I. Pigment Red 53:1, C.I. Pigment Red 57:1 (Brilliant Carmine 6B), C.I. Pigment Red 60:1, C.I. Pigment Red 63:1, C.I. Pigment Red 64:1, C.I. Pigment Red 81. C.I. Pigment Red 83, C.I. Pigment Red 88, C.I. Pigment Red 101(colcothar), C.I. Pigment Red 104, C.I. Pigment Red 106, C.I. Pigment Red 108 (Cadmium Red), C.I. Pigment Red 112, C.I. Pigment Red 114, C.I. Pigment Red 122 (Quinacridone Magenta), C.I. Pigment Red 123, C.I. Pigment Red 139, C.I. Pigment Red 44, C.I. Pigment Red 146, C.I. Pigment Red 149, C.I. Pigment Red 166, C.I. Pigment Red 168, C.I. Pigment Red 170, C.I. Pigment Red 172, C.I. Pigment Red 177, C.I. Pigment Red 178, C.I. Pigment Red 179, C.I. Pigment Red 185, C.I. Pigment Red 190, C.I. Pigment Red 193, C.I. Pigment Red 209, C.I. Pigment Red 219 and C.I. Pigment Red 222, C.I. Pigment Violet 1 (Rhodamine Lake), C.I. Pigment Violet 3, C.I.

Pigment Violet 5:1, C.I. Pigment Violet 16, C.I. Pigment Violet 19, C.I. Pigment Violet 23 and C.I. Pigment Violet 38.

Examples of pigments for orange or yellow include: C.I. Pigment Yellow 1, C.I. Pigment Yellow 3, C.I. Pigment Yellow 12, C.I. Pigment Yellow 13, C.I. Pigment Yellow 14, C.I. Pigment Yellow 15, C.I. Pigment Yellow 15:3, C.I. Pigment Yellow 17, C.I. Pigment Yellow 24, C.I. Pigment Yellow 34, C.I. Pigment Yellow 35, C.I. Pigment Yellow 37, C.I. Pigment Yellow 42 (yellow iron oxides), C.I. Pigment Yellow 53, C.I. Pigment Yellow 55, C.I. Pigment Yellow 74, C.I. Pigment Yellow 81, C.I. Pigment Yellow 83, C.I. Pigment Yellow 93, C.I. Pigment Yellow 94, C.I. Pigment Yellow 95, C.I. Pigment Yellow 97, C.I. Pigment Yellow 98, C.I. Pigment Yellow 100, C.I. Pigment Yellow 101, C.I. Pigment Yellow 104, C.I. Pigment Yellow 408, C.I. Pigment Yellow 109, C.I. Pigment Yellow 110, C.I. Pigment Yellow 117, C.I. Pigment Yellow 120, C.I. Pigment Yellow 128, C.I. Pigment Yellow 138, C.I. Pigment Yellow 150, C.I. Pigment Yellow 151, C.I. Pigment Yellow 153 and C.I. Pigment Yellow 183; C.I. Pigment Orange 5, C.I. Pigment Orange 13, C.I. Pigment Orange 16, C.I. Pigment Orange 17, C.I. Pigment Orange 31, C.I. Pigment Orange 34, C.I. Pigment Orange 36, C.I. Pigment Orange 43, and C.I. Pigment Orange 51.

Examples of pigments for green or cyan include: C.I. Pigment Blue 1, C.I. Pigment Blue 2, C.I. Pigment Blue 15, C.I. Pigment Blue 15:1, C.I. Pigment Blue 15:2, C.I. Pigment Blue 15:3 (Phthalocyanine Blue), C.I. Pigment Blue 16, C.I. Pigment Blue 17:1, C.I. Pigment Blue 56, C.I. Pigment Blue 60, C.I. Pigment Blue 63, C.I. Pigment Green 1, C.I. Pigment Green 4, C.I. Pigment Green 7, C.I. Pigment Green 8, C.I. Pigment Green 10, C.I. Pigment Green 17, C.I. Pigment Green 18 and C.I. Pigment Green 36.

In addition to the above pigments, when red, green, blue or intermediate colors are required, it is preferable that the following pigments are employed individually or in combination thereof. Examples of employable pigments include: C.I. Pigment Red 209, 224, 177, and 194, C.I. Pigment Orange 43, C.I. Vat Violet 3, C.I. Pigment Violet 19, 23, and 37, C.I. Pigment Green 36, and 7, C.I. Pigment Blue 15:6.

Further, examples of pigments for black include: C.I. Pigment Black 1, C.I. Pigment Black 6, C.I. Pigment Black 7 and C.I. Pigment Black 11. Specific examples of pigments for black color ink usable in the present invention include carbon blacks (e.g., furnace black, lamp black, acetylene black, and channel black); (C.I. Pigment Black 7) or metal-based pigments (e.g., copper, iron (C.I. Pigment Black 11), and titanium oxide; and organic pigments (e.g., aniline black (C.I. Pigment Black 1).

Solvent

Water is cited as an environmentally friendly and hence desirable solvent.

Cosolvent

As a cosolvent of the ink, for the purposes of improving the ejection property of the ink or adjusting the ink physical properties, the ink preferably contains a water soluble organic solvent in addition to water. As long as the effect of the present invention is not damaged, there is no restriction in particular in the type of the water soluble organic solvent. Also, more than one cosolvent can be used in the ink used in the present invention.

Examples of the water-soluble organic solvent include polyhydric alcohols, polyhydric alcohol alkyl ethers, polyhydric alcohol aryl ethers, nitrogen-containing heterocyclic compounds, amides, amines, ammonium compounds, sulfur-containing compounds, propylene carbonate, and ethylene carbonate.

Examples of the solvent include: glycerin (also termed glycerol), propylene glycol, dipropylene glycol, tripropylene glycol, tetrapropylene glycol, polypropylene glycol, ethylene glycol, diethylene glycol, triethylene glycol, tetraethylene glycol, polyethylene glycols preferably having a molecular weight of between 200 gram/mol and 1000 gram/mol (e.g. PEG 200, PEG 400, PEG 600, PEG 800, PEG 1000), glycerol ethoxylate, petaerythritol ethoxylate, polyethylene glycol (di)methylethers preferably having a molecular weight of between 200 gram/mol and 1000 gram/mol, tri-methylol-propane, diglycerol (diglycerin), trimethylglycine (betaine), N-methylmorpholine N-oxide, decaglyserol, 1,4-butanediol, 1,3-butanediol, 1,2,6-hexanetriol, 2-pyrrolidinone, dimethylimidazolidinone, ethylene glycol mono-butyl ether, diethylene glycol monomethyl ether, diethylene glycol monoethyl ether, diethylene glycol monopropyl ether, diethylene glycol mono-butyl ether, triethylene glycol monomethyl ether, triethylene glycol monoethyl ether, triethylene glycol mono-propyl ether, triethylene glycol mono-butyl ether, tetraethylene glycol monomethyl ether, tetraethylene glycol monoethyl ether, propylene glycol mono-butyl ether, dipropylene glycol monomethyl ether, dipropylene glycol monoethyl ether, dipropylene glycol monopropyl ether, diethylene glycol monobutyl ether, tripropylene glycol monomethyl ether, tripropylene glycol monoethyl ether, tripropylene glycol monopropyl ether, tripropylene glycol monobutyl ether, tetrapropylene glycol monomethyl ether, diethylene glycol diethyl ether, diethylene glycol dibutyl ether, triethylene glycol diethyl ether, triethylene glycol dibutyl ether, dipropylene glycol dibutyl ether, tri propylene glycol dibutyl ether, 3-methyl 2,4-pentanediol, diethylene-glycol-monoethyl ether acetate, 1,2-hexanediol, 1,2-pentanediol and 1,2-butanediol.

Surfactants

It is preferable that the ink contains at least one surfactant in order to improve an ink ejection property and/or the wettability of the surface of a recording medium, and the image density and color saturation of the image formed and reducing white spots therein. Using surfactants, the surface tension, i.e. the dynamic surface tension as well as the static surface tension, can be adjusted.

Examples of surfactants are not specifically limited. The following can be cited.

Examples of the surfactant include nonionic surfactants, cationic surfactants, anionic surfactants, amphoteric surfactants, in particular betaine surfactants, silicone surfactants, and fluorochemical surfactants.

Examples of a cationic surfactant include: aliphatic amine salts, aliphatic quarternary ammonium salts, benzalkonium salts, benzethonium chloride, pyridinium salts, imidazolinium salts.

Examples of an anionic surfactant include: polyoxyethylene alkylether acetic acid salts, dodecylbenzene sulfonic acid salts, lauric acid salts, and salts of polyoxyethylene alkylether sulfate, an aliphatic acid soap, an N-acyl-N-methyl glycin salt, an N-acyl-N-methyl-β-alanine salt, an N-acylglutamate, an acylated peptide, an alkylsulfonic acid salt, an alkylbezenesulfonic acid salt, an alkylnaphthalenesulfonic acid salt, a dialkylsulfo succinate (e.g. sodium dioctyl sulfosuccinate (DSS); alternative names: docusate sodium, Aerosol OT and AOT), alkylsulfo acetate, α-olefin sulfonate, N-acyl-methyl taurine, a sulfonated oil, a higher alcohol sulfate salt, a secondary higher alcohol sulfate salt, an alkyl ether sulfate, a secondary higher alcohol ethoxysulfate, a polyoxyethylene alkylphenyl ether sulfate, a monoglysulfate, an aliphatic acid alkylolamido sulfate salt, an alkyl ether phosphate salt and an alkyl phosphate salt.

Examples of an amphoteric surfactant include: a carboxybetaine type, a sulfobetaine type, an aminocarboxylate salt and an imidazolium betaine.

Examples of a nonionic surfactant include: polyoxyethylene alkylether, polyoxypropylene polyoxyethylene alkylether, a polyoxyethylene secondary alcohol ether, a polyoxyethylene alkylphenyl ether, a polyoxyethylene sterol ether, a polyoxyethylenelanolin derivative polyoxyethylene polyoxypropylene alkyl ether, polyoxyethylene alkylester, a polyoxyethyleneglycerine aliphatic acid ester, a polyoxyethylene castor oil, a hydrogenated castor oil, a polyoxyethylene sorbitol aliphatic acid ester, a polyethylene glycols aliphatic acid ester, an aliphatic acid monoglyceride, a polyglycerine aliphatic acid ester, a sorbitan aliphatic acid ester, polyoxyethylene sorbitan aliphatic ester, a propylene glycol aliphatic acid ester, a cane sugar aliphatic acid ester, an aliphatic acid alkanol amide, polyoxyethylene alkylamide, a polyoxyethylene aliphatic acid amide, a polyoxyethylene alkylamine, an alkylamine oxide, an acetyleneglycol, an ethoxylated acetylene glycol, acetylene alcohol.

Examples of the fluorochemical surfactants include nonionic fluorochemical surfactants, anionic fluorochemical surfactants, and amphoteric fluorochemical surfactants. Examples of the nonionic fluorochemical surfactants include perfluoroalkyl phosphoric acid ester compounds, perfluoroalkyl ethylene oxide adducts, and polyoxyalkylene ether polymer compounds having perfluoroalkyl ether groups as side chains. Among these, polyoxyalkylene ether polymer compounds having perfluoroalkyl ether groups as side chains are preferable because they are low in foaming property.

As the fluorochemical surfactants, commercially available products may be used. Examples of the commercially available products include SURFLON S-H1, S-112, S-113. S-121, S-131, S-132, S-141 and S-145 (all of which are produced by Asahi Glass Co., Ltd.), FLUORAD FC-93, FC-95, FC-98, FC-129, FC-135, FC-170C, FC-430 and FC-431 (all of which are produced by Sumitomo 3M Limited), MEGAFAC F-470, F-1405 and F-474 (all of which are produced by Dainippon Ink Chemical Industries Co., Ltd.), ZONYL TBS, FSP, FSA, FSN-100, FSN, FSO-100, FSO, FS-300 and UR (all of which are produced by E. I. du Pont de Nemours and Company), FT-110, FT-250, FT-251, FT-400S, FT-150 and FT-400SW (all of which are produced by Neos Company Limited), and POLYFOX PF-136A, PF-156A, PF-151N, PF-154, and PF-159 (all of which are produced by OMNOVA Solutions Inc.). Among these, ZONYL FS-300 (produced by E. I. du Pont de Nemours and Company), FT-110, FT-250, FT-251, FT-400S, FT-150, FT-400SW (produced by Neos Company Limited), and POLYFOX PF-151N (produced by OMNOVA Solutions Inc.) are preferable in that they are excellent in print quality, particularly in color developing ability and in dye-leveling property.

Examples of the silicone surfactant include side-chain-modified polydimethylsiloxane, both-ends-modified polydimethylsiloxane, one-end-modified polydimethylsiloxane, and side-chain/both-ends-modified polydimethylsiloxane. Polyether-modified silicone surfactants having, as a modified group, a polyoxyethylene group or a polyoxyethylene polyoxypropylene group are particularly preferable because they exhibit excellent physical properties as water-based surfactants. The silicone surfactant may be suitably synthesized or commercial products may be used. Commercial products are readily available from BYK Chemie GmbH, Shin-Etsu Chemical Co., Ltd., TORAY Dow Corning Silicone Co., Ltd., Nihon Emulsion Co., Ltd., Kyoeisha Chemical Co., Ltd., or the like.

The polyether-modified silicone surfactant is not particularly limited and may be suitably selected in accordance with the intended use.

As the polyether-modified silicone surfactant, commercial products may be used. Examples of the commercial products include KF-618, KF-642 and KF-643 (produced by Shin-Etsu Chemical Co., Ltd.); EMALEX-SS-5602 and SS-1906EX (produced by Nihon Emulsion Co., Ltd.); FZ-2105, FZ-2118, FZ-2154, FZ-2161, FZ-2162, FZ-2163 and FZ-2164 (produced by TORAY Dow Corning Silicone Co., Ltd.); and BYK-33, BYK 331, BYK 341, BYK 348, BYK 349, BYK 3455, BYK-387 (produced by BYK Chemie GmbH); Tegowet 240, Tegowet 245, Tegowet 250, Tegowet 260 (produced by Evonik); Silwet L-77 (produced by Sabic).

All surfactants mentioned in this section may be used solely, or they may be used in combination.

Additives

The ink composition may optionally further contain additives like biozides or a penetrant, which is a compound that promotes absorption of the ink composition in the print medium, and the additives are not particularly limited and comprise those usually used in inks.

Cover Liquid

The cover liquid used in the present invention is not particularly limited as long as it has a surface tension that is smaller than the surface tension of the at least one ink, particularly the two or more inks, and is in liquid form. The cover liquid can comprise one liquid or a mixture of two or more liquids. Thus, the cover liquid has a surface tension that is lower than the inks used for creating the image on the print. Further, this liquid should be applied on top of the inks immediately after they, respectively the last ink, have/has landed on the recording medium surface, and should to be applied particularly within a time scale of is after the final ink for printing the image has been applied, preferably within a time scale of is after the first ink for printing the image has been applied. Thus, the top layer must be added before this time interval is over, i.e. within 1 s after printing the image, preferably within 1 s after printing the first ink. In the cover liquid, all components add up to 100 m %.

In the present method, the cover liquid can be water-based or solvent-based. According to certain embodiments, the cover liquid is water-based, i.e. contains at least water, as this achieves a better gradient. Further, a solvent-based cover liquid is more complex. The amount of water in the cover liquid is not particularly limited and can be for example between 30 and 70 m %, preferably between 35 and 65 m %, further preferably between 40 and 60 m %, based on 100 m % of the cover liquid.

Apart from that, the cover liquid can also contain one or more liquids that are miscible with water, preferably organic liquids with a high boiling point of more than 60° C., e.g. one or more alcohols, ethers, amides, etc. Using these liquids, e.g. alcohols, the surface tension, particularly the dynamic surface tension, of the cover liquid can be suitably adjusted and determined using simple tests for determining the surface tension, e.g. using a bubble pressure tensiometer—as e.g. described in the Examples, etc. Particular examples of liquids miscible with water include monofuncitional alcohols like methanol, ethanol, propanol, butanol, pentanol, hexanol, heptanol, and/or polyfunctional alcohols, e.g. diols like 1,2 hexanediol, 1,2-butanediol, 1,2 propanediol, 1,2-pentanediol, 1,3-propanediol, 1,3-butanediol, 1,4-butanediol, etc., and/or polyols like glycerol, etc. Also, the amount of liquids miscible with water in the cover liquid is not particularly limited and can be for example between 70 and 20 m %, preferably between 65 and 22 m %, further preferably between 60 and 40 m %, based on 100 m % of the cover liquid. For example, the cover liquid can, in addition to water, comprise a diol like 1,2-hexanediol and a polyol glycerol, wherein the amount of the polyol like glycerol can be between 0 and 75 m %, e.g. between 1 and 72 m %, preferably between 20 and 71 m %, further preferably between 27 and 69.5 m %, more preferably between 37.5 and 59 m %, and the amount of the diol like 1,2-hexanediol can be between 0 and 5 m %, preferably between 0.5 and 3 m %, further preferably between 1 and 2.5 m %, based on 100 m % of the cover liquid.

In addition, the cover liquid can, according to certain embodiments, contain one or more surfactants that can support the mixing of the liquids in the cover liquid and can also help adjust the surface tension of the cover liquid, like in inks. According to certain embodiments, the same surfactants as described with reference to the ink above can be used in the cover liquid, alone or in combination. In preferable embodiments, the surfactant(s) is/are water-soluble. The one or more surfactants can be contained in an amount of between 0 and 2 m %, preferably between 0.1 and 1.5 m %, further preferably between 0.2 and 1.2 m %, even further preferably between 0.2 and 1.0 m %, based on 100 m % of the cover liquid, from an economic and ecologic point of view.

According to certain embodiments, the cover liquid further comprises at least one latex. The latex is thereby not particularly limited and can provide further robustness and/or water repellancy to the print, (spot)gloss control, or UV-absorbance property. For example, the water-dispersible resin described with regard to the ink above can be used, for example an acrylic resin, a styrene-acrylic resin, a urethane resin, an acryl-silicone resin, a fluorine resin and the like, e.g. neocryl acrylic resins from DSM (Netherlands), polyurethanes from ALBERDINGK BOLEY (Germany), etc. According to certain embodiments, the cover liquid comprises at least one resin, e.g. dispersed in the cover liquid, that can form a protective film over the print during evaporation of the cover liquid for extra robustness. The at least one latex can be contained in an amount between 0 and 30 m %, preferably between 1 and 20 m %, further preferably between 5 and 15 m %, more preferably between 8 and 12 m %, e.g. about 10 m %, based on 100 m % of the cover liquid, according to certain embodiments, Alternatively or in addition, the cover liquid can also contain further additives like biocides, e.g. antifungal agents, antifoaming agents, and pH adjustors. Also other functionalities can be added to the cover liquid alternatively or in addition, according to intended use. Furthermore, at least one wax can be contained, particularly when at least one latex is contained, in an amount between 0 and 5 m %, preferably between 1 and 3 m %, based on 100 m % of the cover liquid.

According to certain embodiments, the cover liquid has a viscosity of 1-20 mPas, preferably 4.5-6 mPas at 25° C., measured at 10-1000 rad/s, so that it can be sprayed and/or jetted using a print head. The measurement of the viscosity can be suitably carried out, e.g. by the method described in the Examples, and is not particularly limited. It encompasses usual measurement methods used for determining viscosities in the field of printing, particularly ink-jet printing According to certain embodiments, a full color image is printed before applying the cover liquid, e.g. a full color CMYK image.

According to certain embodiments, the cover liquid should cover 100% of the printed image, particularly 100% of the printed area, i.e. covering the full printed area.

According to certain embodiments, the cover liquid is applied within a time scale of 1 ms to 1 s after printing the image with the at least one ink, preferably after printing the last ink when two or more inks are printed.

In the present printing method, the cover liquid can react with the ink or cannot react with the ink. According to certain embodiments, the cover liquid does not react with the at least one ink to avoid temperature gradients due to reaction. According to certain embodiments, the cover liquid does not contain any crashing agents and/or curable compounds. Such additional compounds can disturb the interface with the inks and also make the liquid system of ink(s) and cover liquid more complicated and expensive. According to certain embodiments, the cover liquid is not curable, i.e. the film formation is a physical process, not a chemical one.

The application of the cover liquid is not particularly limited, but preferably the cover liquid is applied by a non-contact method, including for example jetting, spraying, etc. According to certain embodiments, the cover liquid is sprayed and or jetted, particularly jetted, onto the printed image printed with the at least one ink on the recording medium. Thus, according to certain embodiments, the cover liquid is jettable for easy and fast application on top of the print. According to certain embodiments, an extra printhead in the machine is then necessary for jetting said anti-bleeding liquid. During spraying or jetting, it is preferable that the droplets of the cover liquid are not too big in order to not disturb the printed image. According to certain embodiments, the jetted droplets of the overcoat have a size of 0.1 to 100 pl, preferably 1 to 20 pl, more preferably 2 to 12 pl. In addition, the application speed of the cover liquid droplets should, according to certain embodiments, be not too fast, and the application speed of a usual printhead is normally sufficient, e.g. application of the inks within 1 sec.

According to certain embodiments, the at least one ink has a surface tension, particularly a dynamic surface tension, of between 20 and 45 mN/m, preferably between 25 and 45 mN/m, further preferably between 25 and 45 mN/m, and preferably all inks have a surface tension between 20 and 45 mN/m, preferably between 25 and 45 mN/m, further preferably between 25 and 45 mN/m.

According to certain embodiments, the cover liquid has a surface tension between 10 and 40 mN/m, preferably between 15 and 40 mN/m, further preferably between 15 and 35 mN/m.

According to certain embodiments, the surface tension, particularly the dynamic surface tension, of the cover liquid is at least 0.5 mN/m lower that than to the at least one ink, respectively the inks, preferably at least 1 mN/m lower, further preferably at least 2 mN/m lower, more preferably at least 3 mN/m lower and particularly at least 5 mN/m lower.

For the ink(s) and the cover liquid, it is not important in which way the surface tension, particularly the dynamic surface tension, of each are measured, as long as all of them are measured using the same technique and particularly also the same measuring apparatus. It is only important that the surface tension of the cover liquid is lower than that of the ink(s). According to certain embodiments, the dynamic surface tension of the cover liquid is lower than that of the ink(s), and according to certain embodiments both the static and dynamic surface tension of the cover liquid are lower than that of the ink(s).

According to certain embodiments, the at least one ink is water-based and the cover liquid comprises at least one latex.

In another aspect, the present invention relates to an ink-jet printing apparatus, comprising: at least one printing unit configured to print an image with at least one ink on a recording medium; and an application unit configured to apply the cover liquid on the image formed with the at least one ink within 1 s after printing the image with the at least one ink, wherein the cover liquid has a surface tension that is smaller than the surface tension of the at least one ink.

The printing unit in the ink-jet printing apparatus is not particularly restricted, and any suitable printing unit, like the ones used in ink-jet printing apparatuses in general, can be used. The ink-jet printing apparatus can, according to certain embodiments, contain at least two printing units for two different inks, e.g. two, three or four different printing units for printing a full color picture, e.g. CMYK, on one side of a recording medium. Further, the ink-jet printing apparatus of the present invention can also be configured for double-sided printing, wherein, e.g. each side is printed on and treated with the cover liquid separately.

According to certain embodiments, the application unit for applying the cover liquid is configured to apply the cover liquid within a time scale of 1 ms to 1 s after printing the image with the at least one ink.

According to certain embodiments, the application unit for applying the cover liquid is configured to jet the cover liquid onto the printed image printed with the at least one ink on the recording medium.

Apart from the printing unit(s) and application unit for the cover liquid, the ink-jet printing apparatus of the present invention can contain any parts which are normally contained in an ink-jet printing apparatus, e.g. a transporting mechanism, a fixing mechanism, etc. without any limitations, and these parts are not restricted in any way, but omitted for brevity.

In the following FIGS. 1 and FIGS. 2A-2C, an exemplary ink-jet printing apparatus will be described with reference to several parts thereof, apart from printing units and an application unit for the cover liquid, but the present ink-jet printing apparatus is not restricted to any of these parts. Rather, any suitable parts used in ink-jet printing apparatuses can be used in an ink-jet printing apparatus of the present invention.

An exemplary printing process in an ink-jet printing apparatus of the present invention will now be described with reference to the appended drawings shown in FIG. 1 and FIGS. 2A-2C. FIGS. 1 and FIGS. 2A-2C are schematic representations of an inkjet printing system and an inkjet marking device, respectively. However, the present ink-jet printing process and ink-jet printing apparatus are not limited to this exemplary embodiment.

FIG. 1 shows that a sheet of a recording medium, in particular a machine coated medium, P, is transported in a direction for conveyance as indicated by arrows 50 and 51 and with the aid of transportation mechanism 12. Transportation mechanism 12 may be a driven belt system comprising one (as shown in FIG. 1) or more belts. Alternatively, one or more of these belts may be exchanged for one or more drums. A transportation mechanism may be suitably configured depending on the requirements (e.g. sheet registration accuracy) of the sheet transportation in each step of the printing process and may hence comprise one or more driven belts and/or one or more drums. For a proper conveyance of the sheets of receiving medium, the sheets need to be fixed to the transportation mechanism. The way of fixation is not particularly limited and may be selected from electrostatic fixation, mechanical fixation (e.g. clamping) and vacuum fixation. Of these, vacuum fixation is preferred.

The printing process as described below comprises the following steps: media pre-treatment, image formation, application of cover liquid, drying and fixing and optionally post treatment.

Media Pre-Treatment

To improve the spreading and pinning (i.e. fixation of pigments and water-dispersed polymer particles) of the ink on the recording medium, in particular on slow absorbing media, such as machine coated media, the recording medium may be pretreated, i.e. treated prior to printing an image on the medium. The pre-treatment step may comprise one or more of the following:

- preheating of the receiving medium to enhance spreading of the used ink on the receiving medium and/or to enhance absorption of the used ink into the receiving medium;
- primer pre-treatment for increasing the surface tension of receiving medium in order to improve the wettability of the receiving medium by the used ink and to control the stability of the dispersed solid fraction of the ink composition (i.e. pigments and dispersed polymer particles). Primer pre-treatment may be performed in the gas phase, e.g. with gaseous acids such as hydrochloric acid, sulfuric acid, acetic acid, phosphoric acid and lactic acid, or in the liquid phase by coating the recording medium with a pre-treatment liquid. The pre-treatment liquid may comprise water as a solvent, one or more cosolvents, additives such as surfactants and at least one compound selected from a polyvalent metal salt, an acid and a cationic resin; and
- corona or plasma treatment.

Primer Pre-Treatment

As an application way of the pre-treatment liquid, any conventionally known methods can be used. Specific examples of an application way include: a roller coating, an ink-jet application, a curtain coating and a spray coating. There is no specific restriction in the number of times with which the pre-treatment liquid is applied. It may be applied at one time, or it may be applied in two times or more. Application in two times or more may be preferable, since cockling of the coated printing paper can be prevented and the film formed by the surface pre-treatment liquid will produce a uniform dry surface having no wrinkles by applying in 2 steps or more.

Especially a roller coating (see 14 in FIG. 1) method is preferable because this coating method does not need to take into consideration of ejection properties and it can apply the pre-treatment liquid homogeneously to a recording medium. In addition, the amount of the applied pre-treatment liquid with a roller or with other means to a recording medium can be suitably adjusted by controlling: the physical properties of the pre-treatment liquid; and the contact pressure of a roller in a roller coater to the recording medium and the rotational speed of a roller in a roller coater which is used for a coater of the pre-treatment liquid. As an application area of the pre-treatment liquid, it may be possible to apply only to the printed portion, or to the entire surface of both the printed portion and the non-printed portion. However, when the pre-treatment liquid is applied only to the printed portion, unevenness may occur between the application area and a non-application area caused by swelling of cellulose contained in the coated printing paper with the water in the pre-treatment liquid followed by drying. Then, from the viewpoint of drying uniformly, it is preferable to apply a pre-treatment liquid to the entire surface of a coated printing paper, and roller coating can be preferably used as a coating method to the whole surface. The pre-treatment liquid may be an aqueous pre-treatment liquid.

Corona or Plasma Treatment

Corona or plasma treatment may be used as a pre-treatment step by exposing a sheet of a recording medium to corona discharge or plasma treatment. In particular, when used on media like polyethylene (PE) films, polypropylene (PP) films, polyetyleneterephtalate (PET) films and machine coated media, the adhesion and spreading of the ink can be improved by increasing the surface energy of the media. With machine coated media, the absorption of water can be promoted, which may induce faster fixation of the image and less puddling on the receiving medium. Surface properties of the receiving medium may be tuned by using different gases or gas mixtures as medium in the corona or plasma treatment. Examples are air, oxygen, nitrogen, carbon dioxide, methane, fluorine gas, argon, neon and mixtures thereof. Corona treatment in air is most preferred.

FIG. 1 shows that the sheet of receiving medium P may be conveyed to and passed through a first pre-treatment module 13, which module may comprise a preheater, for example a radiation heater, a corona/plasma treatment unit, a gaseous acid treatment unit or a combination of any of the above. Optionally and subsequently, a predetermined quantity of the pre-treatment liquid is applied on the surface of the receiving medium P at pre-treatment liquid applying member 14. Specifically, the pre-treatment liquid is provided from storage tank 15 of the pre-treatment liquid to the pre-treatment liquid applying member 14 composed of double rolls 16 and 17. Each surface of the double rolls may be covered with a porous resin material such as sponge. After providing the pre-treatment liquid to auxiliary roll 16 first, the pre-treatment liquid is transferred to main roll 17, and a predetermined quantity is applied on the surface of the recording medium P. Subsequently, the coated printing paper P on which the pre-treatment liquid was supplied may optionally be heated and dried by drying member 18, which is composed of a drying heater installed at the downstream position of the pre-treatment liquid applying member 14 in order to decrease the quantity of the water content in the pre-treatment liquid to a predetermined range. It is preferable to decrease the water content in an amount of 1.0 weight % to 30 weight % based on the total water content in the provided pre-treatment liquid provided on the receiving medium P.

To prevent the transportation mechanism 12 being contaminated with pre-treatment liquid, a cleaning unit (not shown) may be installed and/or the transportation mechanism may be comprised of multiple belts or drums as described above. The latter measure prevents contamination of the upstream parts of the transportation mechanism, in particular of the transportation mechanism in the printing region.

Image Formation

Image formation is performed in such a manner that, employing an inkjet printer loaded with inkjet inks, ink droplets are ejected from the inkjet heads based on the digital signals onto a print medium.

Although both single pass inkjet printing and multi pass (i.e. scanning) inkjet printing may be used for image formation, single pass inkjet printing is preferably used since it is effective to perform high-speed printing. Single pass inkjet printing is an inkjet recording method with which ink droplets are deposited onto the receiving medium to form all pixels of the image by a single passage of a recording medium underneath an inkjet marking module.

In FIG. 1, 11 represents an inkjet marking module comprising four inkjet marking devices, indicated with 111, 112, 113 and 114, each arranged to eject an ink of a different color (e.g. Cyan, Magenta, Yellow and blacK). The nozzle pitch of each head is, e.g. about 360 dpi. In the present invention, "dpi" indicates a dot number per 2.54 cm.

Figure 2A:
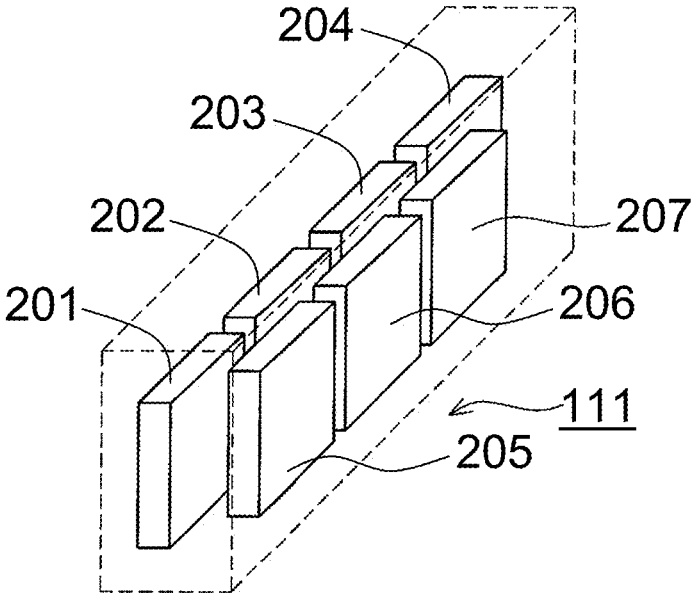
Figure 2B:
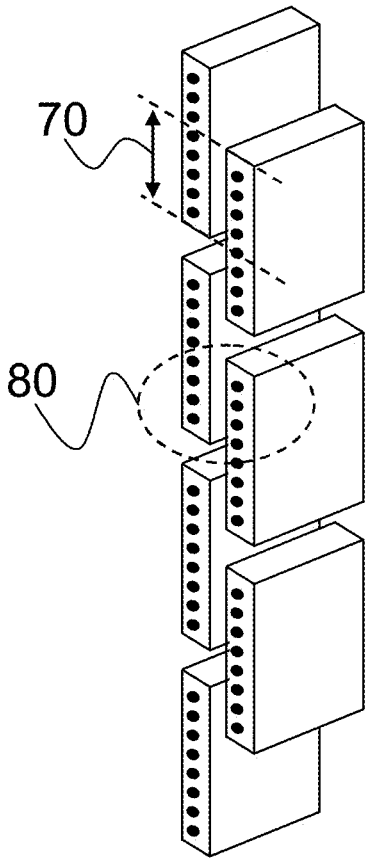
Figure 2C:
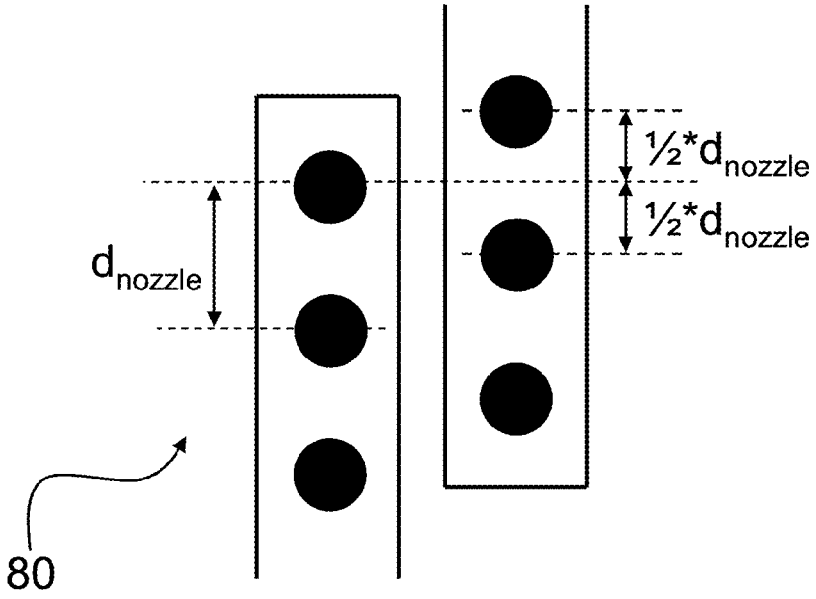

An inkjet marking device for use in single pass inkjet printing, 111, 112, 113, 114, has a length, L, of at least the width of the desired printing range, indicated with double arrow 52, the printing range being perpendicular to the media transport direction, indicated with arrows 50 and 51. The inkjet marking device may comprise a single printhead having a length of at least the width of said desired printing range. The inkjet marking device may also be constructed by combining two or more inkjet heads, such that the combined lengths of the individual inkjet heads cover the entire width of the printing range. Such a constructed inkjet marking device is also termed a page wide array (PWA) of printheads. FIG. 2A shows an inkjet marking device 111 (112, 113, 114 may be identical) comprising 7 individual inkjet heads (201, 202, 203, 204, 205, 206, 207), which are arranged in two parallel rows, a first row comprising four inkjet heads (201-204) and a second row comprising three inkjet heads (205-207), which are arranged in a staggered configuration with respect to the inkjet heads of the first row. The staggered arrangement provides a page wide array of nozzles, which are substantially equidistant in the length direction of the inkjet marking device. The staggered configuration may also provide a redundancy of nozzles in the area where the inkjet heads of the first row and the second row overlap, see 70 in FIG. 2B. Staggering may further be used to decrease the nozzle pitch (hence increasing the print resolution) in the length direction of the inkjet marking device, e.g. by arranging the second row of inkjet heads such that the positions of the nozzles of the inkjet heads of the second row are shifted in the length direction of the inkjet marking device by half the nozzle pitch, the nozzle pitch being the distance between adjacent nozzles in an inkjet head, $d_{nozzle}$ (see FIG. 2C, which represents a detailed view of 80 in FIG. 2B). The resolution may be further increased by using more rows of inkjet heads, each of which are arranged such that the positions of the nozzles of each row are shifted in the length direction with respect to the positions of the nozzles of all other rows.

In image formation by ejecting an ink, an inkjet head (i.e. a printhead) employed may be either an on-demand type or a continuous type inkjet head. As an ink ejection system, there may be usable either the electric-mechanical conversion system (e.g., a single-cavity type, a double-cavity type, a bender type, a piston type, a shear mode type, or a shared wall type), or an electric-thermal conversion system (e.g., a thermal inkjet type, or a Bubble Jet type (registered trade name)). Among them, it is preferable to use a piezo type inkjet recording head which has nozzles of a diameter of 30 μm or less in the current image forming method.

FIG. 1 shows that after pre-treatment, the receiving medium P is conveyed to an upstream part of the inkjet marking module 11. Then, image formation is carried out by each color ink ejecting from each inkjet marking device 111, 112, 113 and 114 arranged so that the whole width of the receiving medium P is covered.

Optionally, the image formation may be carried out while the recording medium is temperature controlled. For this purpose a temperature control device 19 may be arranged to control the temperature of the surface of the transportation mechanism (e.g. belt or drum) underneath the inkjet marking module 11. The temperature control device 19 may be used to control the surface temperature of the recording medium P, for example in the range of 30° C. to 60° C. The temperature control device 19 may comprise heaters, such as radiation heaters, and a cooling mechanism, for example a cold blast, in order to control the surface temperature of the receiving medium within said range. Subsequently and while printing, the receiving medium P is conveyed to the downstream part of the inkjet marking module 11.

Application of Cover Liquid

In a subsequent step, the cover liquid described above is applied onto the printed image using an application unit 21. The method of applying the cover liquid is not particularly limited, and is selected from various methods depending on the type of the cover liquid. However, the same method as used in the coating method of the pre-treatment liquid or an inkjet printing method is preferably used. E.g. the cover liquid can be jetted using a configuration similar to any of the inkjet marking devices 111, 112, 113, 114 used for printing the image, as described above, securing that at least the whole printed image is covered by the cover liquid. The application unit 21 is thereby arranged as close to the last inkjet marking device 111 as possible, particularly that the cover liquid is applied within is after application of the last ink in the inkjet marking device 111, preferably within is after printing the first ink.

Drying and Fixing

After an image has been formed on the receiving medium and the cover liquid has been applied, the prints have to be dried and the image has to be fixed onto the receiving medium. Drying comprises the evaporation of solvents, in particular those solvents that have poor absorption characteristics with respect to the selected recording medium. Care is to be taken that also the liquids from the cover liquid are evaporated.

FIG. 1 schematically shows a drying and fixing unit 20, which may comprise a heater, for example a radiation heater. After an image has been formed and the cover liquid has been applied, the print is conveyed to and passed through the drying and fixing unit 20. The print is heated such that solvents present in the printed image, to a large extent water, evaporate. The speed of evaporation and hence drying may be enhanced by increasing the air refresh rate in the drying and fixing unit 20. Simultaneously, film formation of the ink occurs, because the prints are heated to a temperature above the minimum film formation temperature (MFT). The residence time of the print in the drying and fixing unit 20 and the temperature at which the drying and fixing unit 20 operates are optimized, such that when the print leaves the drying and fixing unit 20 a dry and robust print has been obtained. As described above, the transportation mechanism 12 in the fixing and drying unit 20 may be separated from the transportation mechanism of the pre-treatment and printing section of the printing apparatus and may comprise a belt or a drum.

Hitherto, the printing process was described such that the image formation step was performed in-line with the pre-treatment step (e.g. application of an (aqueous) pre-treatment liquid), the step of applying the cover liquid and a drying and fixing step, all performed by the same apparatus (see FIG. 1). However, the printing process is not restricted to the above-mentioned embodiment. A method in which two or more machines are connected through a belt conveyor, drum conveyor or a roller, and the step of applying a pre-treatment liquid, the (optional) step of drying a coating solution, the step of ejecting an inkjet ink to form an image, the step of applying a cover liquid and the step or drying an fixing the printed image are performed. It is, however, preferable to carry out image formation with the above defined in-line image forming method.

EXAMPLES

A printing process carried out in the examples corresponds to the one described above, without using a pre-treatment, drying step or post-treatment step to illustrate the effect of the present invention. Drying was carried out as described in the respective Comparative Examples and Examples.

For determining the respective parameters that influence the printing process, the dynamic surface tension of the inks and the cover liquid was measured using the bubble pressure method, and further the viscosity of the cover liquid was determined, as follows.

Surface Tension

The surface tension is measured using a Sita bubble pressure tensiometer, model SITA online t60, according to the (maximum) bubble pressure method. The surface tension of the liquids to be tested (e.g. inks according to the present invention) is measured at 25° C. unless otherwise indicated. The measurement is performed by measuring bubble life time between 20 ms and 6000 ms. The dynamic surface tension is recorded at 40 ms and the static surface tension is estimated at 6000 ms.

Viscosity

The viscosity is measured using a Haake Rheometer, type Haake Rheostress RS 600, with a flat plate geometry at a temperature of 25° C. unless otherwise indicated. The viscosity is measured at shear rates ($\dot{\gamma}$) in the range of between 10 $s^{-1}$ and 1000 $s^{-1}$, unless otherwise indicated.

Materials

All materials used in the examples are used as obtained from the supplier, unless otherwise stated. The suppliers of the used materials are indicated in the specific examples.

The recording media used in the Examples is the machine coated media TCP Gloss (Top Coated Pro Gloss obtained from Océ).

The ink used was iQuarius Aqueous Pigment ink (obtained from Océ, Netherlands), using cyan, magenta, yellow and black ink, as stated in the examples.

For the inks, the following surface tensions were obtained:

Yellow: surface tension@2000 ms/½ Hz [mN/m]: 22.8
Cyan: surface tension@2000 ms/½ Hz [mN/m]: 22.9
Magenta: surface tension@2000 ms/½ Hz [mN/m]: 22.7
Black: surface tension@2000 ms/½ Hz [mN/m]: 23.5

The composition, surface tension and viscosity of the respective cover liquids is given in each Example.

Reference Example 1, Comparative Examples 1 and 2

Figure 3A:
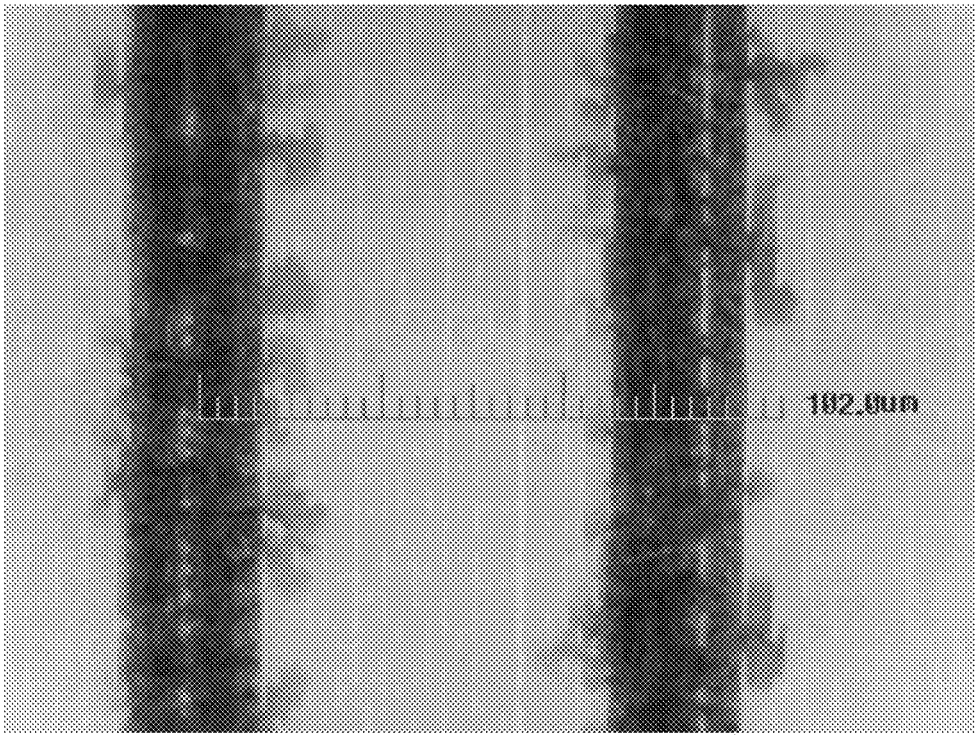
FIGS. 3A-3C show the results obtained in Reference Example 1 and Comparative Examples 1 and 2.
Figure 3B:
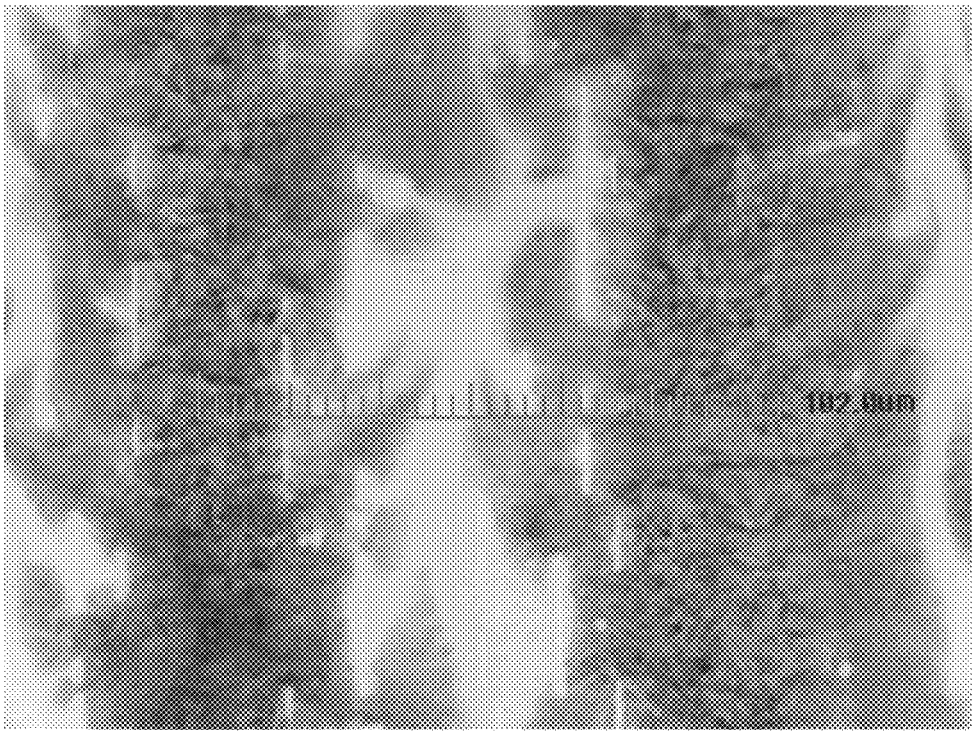
Figure 3C:
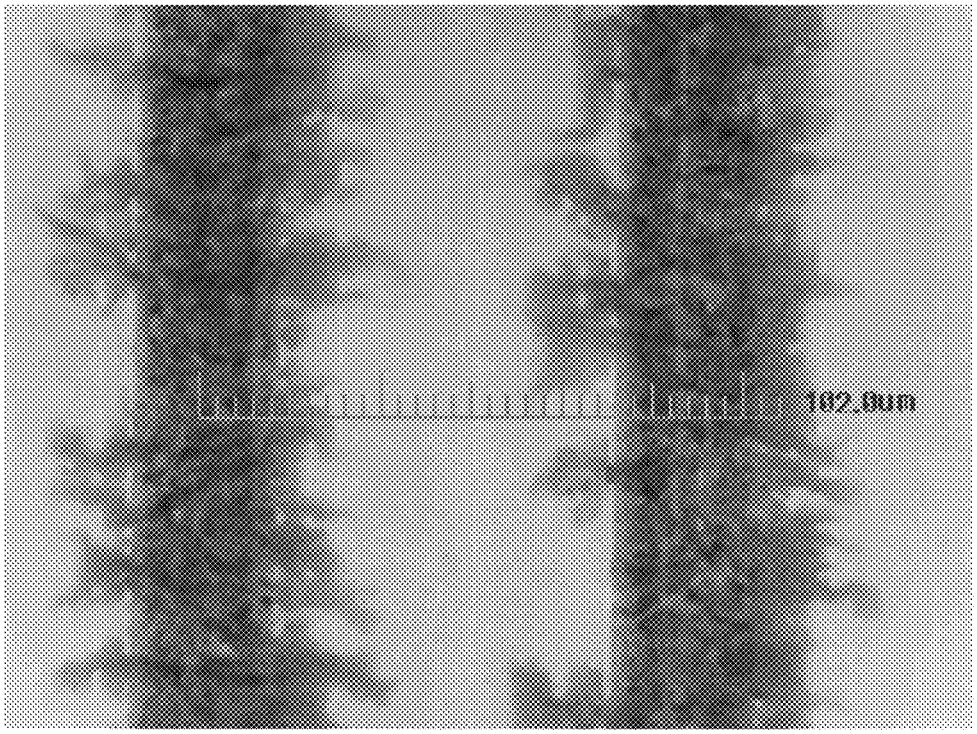

In this test, a Yellow and Cyan ink, as above, were printed on top of each other at a droplet speed of 6 m/s with 4 pl liquid per drop. Immediately after printing, i.e. within less than 1 s of the first application of ink, a third printhead jetted a full layer of a cover liquid with a surface tension of 30 mN/m (viscosity 5.4 mPa·s), which is higher than that of the inks, was jetted on top of the print, in Comparative Example 1 with dot size 3 and in Comparative Example 2 with dot size 1. The cover liquid used for top coating contained 50 m % Glycerol, 1.6 m % 1,2-hexanediol, 47.4% Water and 1 m % Triton X-100. Drying was carried out in an oven at 70° C.

for 60 seconds. Pictures of the results were taken of the result, and the results can be seen in FIGS. 3A-3C, with FIG. 3A showing the results in the Reference Example, and FIGS. 3B and 3C showing the results in Comparative Examples 1 and 2, respectively. As can be seen from the figures, the application of a cover liquid with a surface tension higher than that of the ink cannot control bleeding, but rather leads to equal or increased bleeding of the inks.

Examples 1 and 2

Figure 4A:
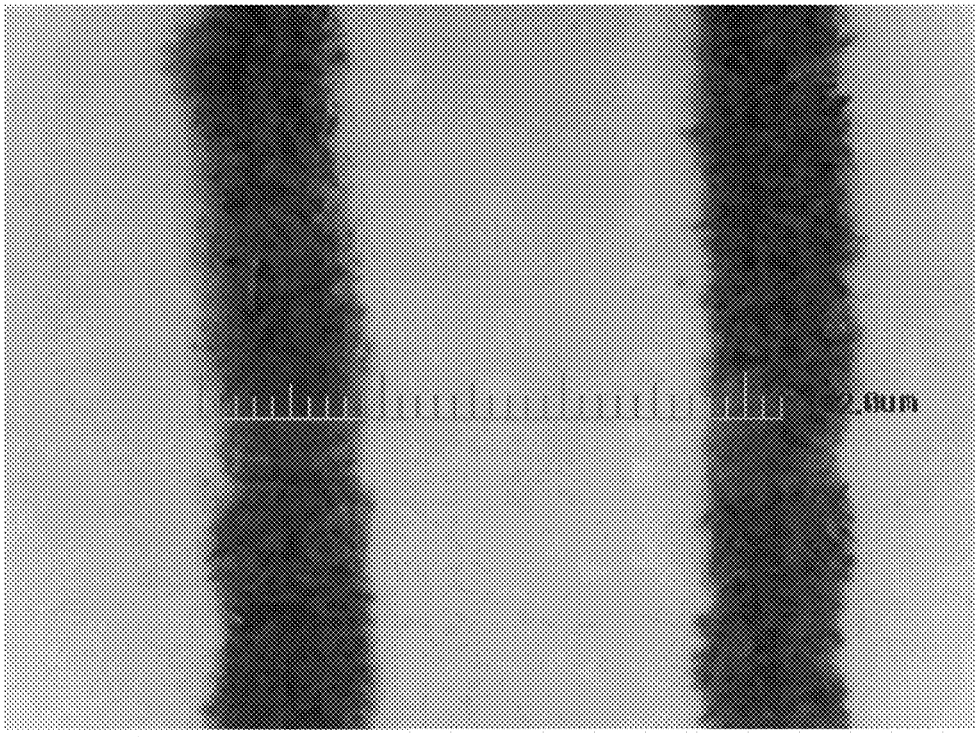
FIGS. 4A-B show the results obtained in Examples 1 and 2.
Figure 4B:
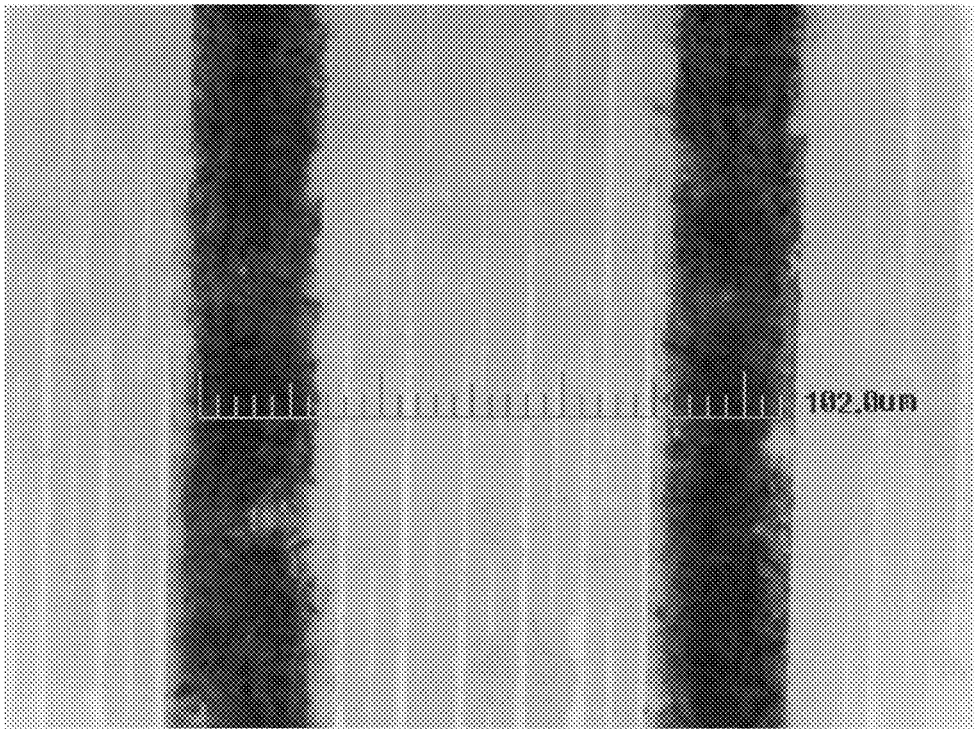

In a second test, the former test for Reference Example 1 and Comparative Examples 1 and 2 was repeated in the same way, except that the cover liquid had a surface tension of 15 mN/m (viscosity 5.4 mPa·s), which is lower than the surface tension of the applied inks. The recipe of the cover liquid in Examples 1 and 2 was 47 m % Glycerol, 50 m % Water, 2 m % 1,2-hexanediol and 1 m % Capstone FS51 (amphoteric amine oxide-based fluorosurfactant). The results of Examples 1 and 2, respectively, can be seen in FIG. 4A and FIG. 4B. Compared to FIG. 3A, which is again used as reference, the cover liquid used in Examples 1 and 2 could effectively prevent bleeding of the inks, as can be seen from FIGS. 4A and 4B.

Reference Example 2, Comparative Example 3, Example 3

The effect seen in Examples 1 and 2 in contrast to Comparative Examples 1 and 2 can also be seen when using cover liquids containing latex in the same setup as in the above examples. The cover liquids were thereby printed on cyan, magenta and yellow inks. Both a latex topcoat with low and high surface tension were printed directly onto the inks to increase robustness, and here similar results were found. The recipes of the two latex topcoats used were as follows:

Composition of Cover Liquid in Comparative Example 3: (Surface Tension 39.0 mN/m, Viscosity: 4.0 mPa·s)

10 m % Alberdink Boley U9800
10 m % 2-pyrollidone
10 m % pentaerythritol, ethoxylated
5 m % glycerol
1 m % Pluronic 105
64 m % UHQ-water Composition of Cover Liquid in Example 3: (Surface Tension 20.0 mN/m, Viscosity 4.0 mPa·s)

Figure 5A:
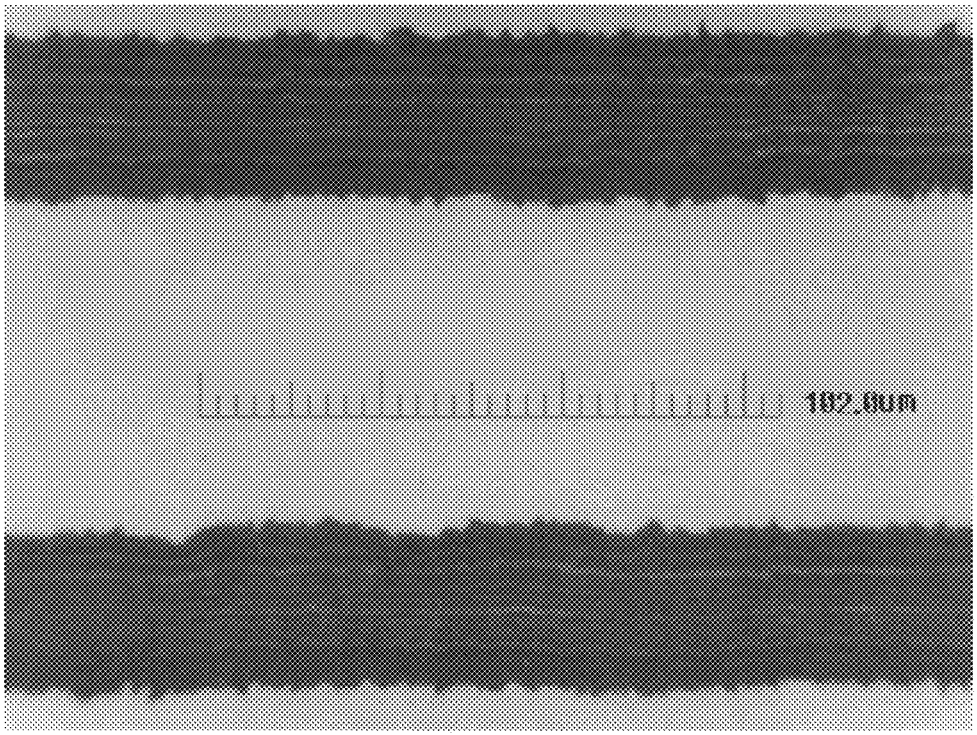
FIGS. 5A-C show the results obtained in Reference Example 2, Comparative Example 3, and Example 3.
Figure 5B:
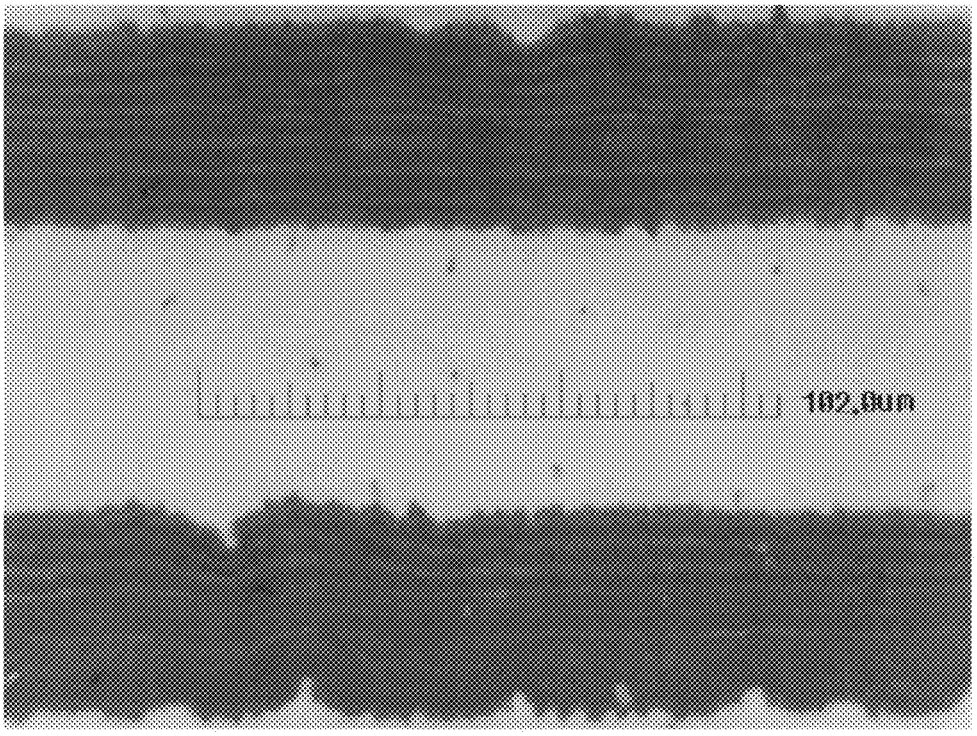
Figure 5C:
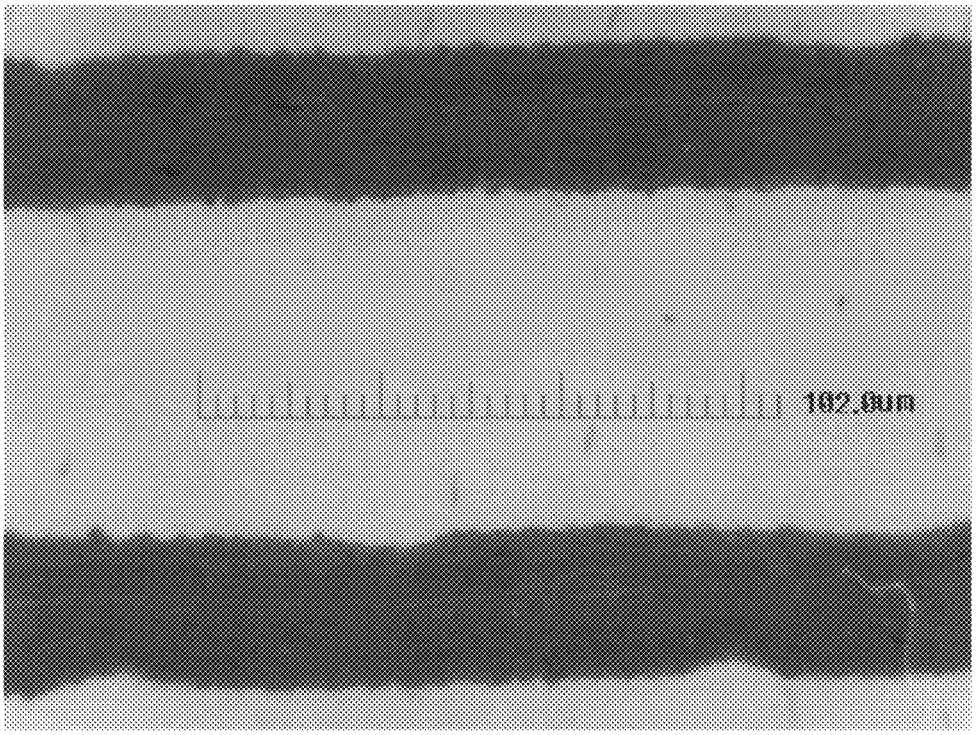

10 m % Alberdink Boley U9800
10 m % 2-pyrollidone
10 m % pentaerythritol ethoxylated
5 m % glycerol
1 m % Capstone FS50 (amphoteric fluorosurfactant)
64 m % UHQ-water The results without a cover liquid are shown in FIG. 5A, the results with the high surface tension liquid in FIG. 5B and the results with the cover liquid having a lower surface tension in FIG. 5C. As can be seen from the Figures, the results obtained in the previous Examples 1 and 2 and Comparative Examples 1 and 2 could be reproduced also with a cover liquid containing latex, and again the cover liquid having a surface tension lower than the printing inks could effectively prevent bleeding, as can be seen when comparing FIGS. 5A and 5C. The use of the cover liquid with a higher surface tension in FIG. 5B resulted in increased bleeding.

Comparative Example 4

Comparative Example 4 was carried out as Example 3, except that the cover liquid was applied as a pre-treatment liquid before printing the inks, and no cover liquid was applied afterwards. As a result, a spreading effect and puddling could be observed. Applying a pre-treatment liquid with a higher surface tension did not change the obtained result.

Using the present printing method, color bleed can be sufficiently prevented by in-line jetting a cover liquid on top of a wet print with a lower surface tension than the inks used for printing. The jetted ink droplets forming the wet print, having a higher surface tension than the cover liquid, tend to bleed into each other due to the creation of a surface tension gradient between neighboring ink droplet surfaces before the wet print is dried which fixes the ink droplets. When the cover liquid, having a lower surface tension than the inks used, is applied on top of the wet print before drying the wet print, the cover liquid suppresses the bleeding tendencies of the ink droplets. Thus, by jetting the cover liquid on top of a wet print the color bleeding can be countered before the wet print is dried by, for example, a drying and fixing unit 20. Hence, the application unit 21 is thereby arranged as close to the last inkjet marking device 111 as possible, particularly that the cover liquid is applied within is after application of the last ink in the inkjet marking device 111, preferably within 1 s after printing the first ink.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An ink-jet printing method, comprising the steps of:
printing an image comprising a plurality of ink droplets with at least one ink on a recording medium; and
applying a cover liquid on the image formed with the at least one ink
wherein the cover liquid is formed within 1 s after printing the image with the at least one ink and has a surface tension that is smaller than a surface tension of the at least one ink to suppress bleeding of the ink droplets, and
wherein the at least one ink is water-based and the cover liquid comprises at least one latex.

2. The ink-jet printing method of claim 1, wherein the cover liquid is applied within a time scale of 1 ms to 1 s after printing the image with the at least one ink.

3. The ink-jet printing method of claim 1, wherein the cover liquid does not react with the at least one ink.

4. The ink-jet printing method of claim 1, wherein the step of applying the cover liquid comprises jetting the cover liquid onto the printed image printed with the at least one ink on the recording medium.

5. The ink-jet printing method of claim 1, wherein the surface tension of the at least one ink is between 20 and 45 mN/m.

6. The ink-jet printing method of claim 1, wherein the cover liquid has a viscosity of 4.5-6 mPas at 25° C., measured at 10-1000 rad/s.

7. The ink-jet printing method of claim 1, wherein the jetted droplets of the cover liquid have a size of 0.1 to 100 pl, preferably 1 to 20 pl.

8. The ink-jet printing method of claim 7, wherein the at least one ink has a dynamic serface tension between 20 and 45 mN/m and the cover liquid has a surface tension between 10 and 40 mN/m.

9. The ink-jet printing method of claim 1, wherein the cover liquid comprises 47 m % glycerol, 50 m % water, 2 m % 1,2hexanediol and 1 m % amphotric amine oxide-based fluorosurfactant.

* * * * *